US009482094B2

(12) United States Patent
Justl et al.

(10) Patent No.: US 9,482,094 B2
(45) Date of Patent: Nov. 1, 2016

(54) GAS TURBINE AND TURBINE BLADE FOR SUCH A GAS TURBINE

(71) Applicant: ALSTOM Technology Ltd, Baden (CH)

(72) Inventors: Sascha Justl, Zürich (CH); Carlos Simon-Delgado, Baden (CH); Thomas Zierer, Ennetbaden (CH); Sven Olmes, Windisch (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 437 days.

(21) Appl. No.: 14/061,018

(22) Filed: Oct. 23, 2013

(65) Prior Publication Data

US 2014/0112798 A1 Apr. 24, 2014

(30) Foreign Application Priority Data

Oct. 23, 2012 (EP) ..... 12189577

(51) Int. Cl.
*F01D 5/08* (2006.01)
*F01D 5/18* (2006.01)

(52) U.S. Cl.
CPC ..... *F01D 5/081* (2013.01); *F01D 5/082* (2013.01); *F01D 5/187* (2013.01); *F05B 2240/801* (2013.01)

(58) Field of Classification Search
CPC ..... F01D 5/081; F01D 5/082; F01D 5/187; F05B 2240/801
See application file for complete search history.

(56) References Cited

U.S. PATENT DOCUMENTS 4,178,129 A 12/1979 Jenkinson
4,348,157 A 9/1982 Campbell et al.
4,595,339 A * 6/1986 Naudet ..... F01D 5/048 415/115
4,759,688 A * 7/1988 Wright ..... F01D 5/087 415/115
4,882,902 A * 11/1989 Reigel ..... F01D 5/082 415/115
4,910,958 A 3/1990 Kreitmeier
5,135,354 A * 8/1992 Novotny ..... F01D 5/081 415/115
5,245,821 A * 9/1993 Thomas, Jr. ..... F01D 9/02 415/116
5,281,097 A * 1/1994 Wilson ..... F01D 5/081 415/115
5,957,660 A * 9/1999 Evans ..... F01D 5/081 415/115
5,984,636 A 11/1999 Fähndrich et al.
6,196,791 B1 * 3/2001 Tomita ..... F01D 5/081 415/115
6,735,956 B2 * 5/2004 Romani ..... F01D 5/081 415/115

(Continued)

FOREIGN PATENT DOCUMENTS

CN 1162345 A 10/1997
CN 102216567 A 10/2011

(Continued)

*Primary Examiner* — Igor Kershteyn
(74) *Attorney, Agent, or Firm* — Buchanan Ingersoll & Rooney PC

(57) ABSTRACT

A gas turbine includes a rotor concentrically surrounded by a casing, with an annular hot gas channel axially extending between the rotor and the casing. The rotor includes a plurality of blades arranged annularly on the rotor. Each of the blades is mounted with a root in a respective axial slot on a rim of the rotor radially extending with an airfoil into the hot gas channel and adjoining with an axially oriented root surface to an annular rim cavity. A cooling device is provided at the root of each blade to receive cooling air injected into the rim cavity through stationary injectors. An optimized cooling is achieved by providing an essentially plane root surface and the cooling device includes a scoop for capturing and redirecting at least part of the injected cooling air, which scoop is a recess with respect to the root surface.

18 Claims, 3 Drawing Sheets

(56) References Cited

U.S. PATENT DOCUMENTS

| | | | | |
|---|---|---|---|---|
| 6,981,845 | B2 * | 1/2006 | Balland | F01D 5/081 416/248 |
| 2006/0120855 | A1 | 6/2006 | Djeridane et al. | |
| 2007/0297918 | A1 | 12/2007 | Pietraszkiewicz et al. | |

FOREIGN PATENT DOCUMENTS

| | | | | |
|---|---|---|---|---|
| DE | 1 106 557 | | 5/1961 | |
| EP | 0 636 765 | | 2/1995 | |
| EP | 2 055 895 | | 5/2009 | |
| FR | 1 355 379 | | 3/1964 | |
| FR | 2 638 206 | | 4/1990 | |
| GB | 751010 | A | 6/1956 | |
| GB | 947553 | A * | 1/1964 | F01D 5/081 |
| GB | 1230325 | A | 4/1971 | |
| GB | 2 225 063 | | 5/1990 | |
| WO | 03/036048 | | 5/2003 | |
| WO | 2010/108879 | | 9/2010 | |

* cited by examiner

GAS TURBINE AND TURBINE BLADE FOR SUCH A GAS TURBINE

CROSS-REFERENCE TO RELATED APPLICATIONS

This application claims priority to European application 12189577.5 filed Oct. 23, 2012, the contents of which are hereby incorporated in its entirety.

TECHNICAL FIELD

The present invention relates to the technology of gas turbines.

It further refers to a turbine blade for such a gas turbine.

BACKGROUND

In the most commonly used blade feed concept of the prior art the blades are fed with cooling air via rotor bores (see for example document WO 2010108879 A1). The increase of the pressure is done via pumping work/centrifugal forces. This is the most common blade feeding system for internal cooled rotating gas turbine blades. This solution might cause life time problems. If not enough space is available, the needed pressure rise might not be sufficient.

Several other blade-feeding concepts exist:

Object of document GB 2225063 is a turbine comprising a stator and a rotor and means for supplying cooling air from the stator to rotor blades secured on the rotor, wherein on the rotor the air supply means includes an insert fitted between each blade base and the rotor disc and forming a deflection chamber closed towards the low pressure side of the rotor, while on the high pressure side the or each insert projects radially inwardly towards the hub over the rotor disc edge so as to form an annular air inlet aperture of the deflection chamber, and on the stator the air. Supply means includes an annular air outlet nozzle directed generally radially outwardly towards the air inlet aperture.

Document U.S. Pat. No. 5,984,636 A describes a cooling arrangement for a bladed rotor in a gas turbine engine, wherein each of the blades includes cooling air passages and a cover with curved fins is mounted adjacent to but connected to the rotor and spaced apart slightly from the rotor disc to form a passageway for the cooling fluid. The cooling arrangement includes a tapered, conically shaped inlet formed in the cooling passage which then diverges to form a diffuser near the outer end of the passageway. The cover includes an enlarged inner portion and a thin outer wall portion beyond the free ring diameter. A hammerhead is formed at the outer periphery of the cover whereby the hammerhead will move closer to the disc in response to centrifugal forces, thus sealing the passage.

Feeding the blade via rotating cover plates (e.g. U.S. Pat. No. 5,984,636). The cover plates are mounted adjacent to the rotor. They are fed on a relatively low radius and the pressure rise is achieved with vanes working like a radial compressor. Complicated design making a separate part attached to the rotor necessary.

Document U.S. Pat. No. 4,178,129 A discloses a cooling system for a turbine of a gas turbine engine, said system comprising a turbine rotor with blades extending there from: a plurality of circumferentially closely spaced pre-swirl nozzles defining a substantially continuous annular outlet flow area through which flows, in operation, a cooling fluid; and a plurality of circumferentially spaced pitot receivers projecting from the blades of the turbine in a direction towards the pre-swirl nozzles and terminating at their free open inlet ends in closely spaced relation to the nozzles with the ends being substantially perpendicular to the relative approach vector of the fluid from the nozzles, the pitot receivers being sized and positioned to collect a portion only of the pre-swirled cooling fluid from the nozzles and to direct it to a portion only of the interior of each of the blades of the turbine.

Thus, recovering pressure from total relative pressure is done in both the pitot tubes and the shank cavity feed. Disadvantageously, the pitot tubes are emerging in to the supply cavity.

Document U.S. Pat. No. 4,348,157 A teaches an air cooled turbine which has cooling air provided through pre-swirl nozzles into an annulus formed between radially inner and outer seals and then into cooling air inlets to the turbine blading, has leakage air deflector means to prevent the leakage flow from the inner to outer seal interfering with the cooling air flow. The deflector means may comprise leakage flow inlets adjacent the inner seal, channels extending radially and cooperating with the turbine rotor to provide passages for the leakage flow to a location radially outboard of the cooling air inlets to the turbine blading, and open portions through which the cooling air can flow to the cooling air inlets. The channel outlets of the deflector may be arranged so that some of the leakage flow can be directed to cool a less critical part of the turbine blading the remaining leakage flow being directed radially outboard of the cooling air inlets to a more critical part of the turbine blading which are arranged to receive the normal cooling air flow.

Document WO 03036048 A1 describes a turbine blade for use in a gas turbine engine, the engine having a hot gas path, a cooling air plenum, and a single stage high work high pressure turbine, the turbine disposed in the hot gas path and having a rotor and a turbine direction of rotation about an axis, the turbine blade comprising: a root portion adapted for mounting to a rotor; an airfoil portion extending from the root portion; a cooling air inlet duct adapted to communicate with the cooling air plenum when installed to the rotor, the air inlet duct having an inlet scoop adapted to extend into the cooling air plenum, the inlet scoop having an inlet scoop aperture oriented and adapted to capture cooling air from the cooling air plenum as a consequence of turbine rotation when the blade is mounted to the rotor; and a cooling air channel defined in an airfoil portion of the blade, the cooling air channel communicating with the cooling air inlet duct and the hot gas path of the engine, the cooling air channel being adapted to permit cooling air captured from the plenum by the cooling air inlet duct to pass through the channel to air outlet means for the purpose of cooling the blade.

The transfer of cooling air from the stationary frame of reference to the turbine blade root in the rotating frame of reference is still afflicted with problems and should be improved in order to improve the efficiency of the turbine.

SUMMARY

It is an object of the present invention to provide a gas turbine, the blades of which are optimized with regard supply of cooling air from an adjoining rim cavity.

It is another object of the invention to provide a turbine blade for such gas turbine.

The gas turbine according to the invention comprises a rotor concentrically surrounded by a casing, with an annular hot gas channel axially extending between said rotor and said casing, said rotor being equipped with a plurality of blades, which are arranged on said rotor in an annular fashion, each of said blades being mounted with a root in a respective axial slot on a rim of said rotor, radially extending with an airfoil into said hot gas channel, and adjoining with an axially oriented root surface to an annular rim cavity, whereby cooling means are provided at the root of each of said blades to receive cooling air being injected into said rim cavity through stationary injecting means, characterized in that said root surface is an essentially plane surface and that said cooling means comprises a scoop for capturing and redirecting at least part of said injected cooling air, which scoop is designed as a recess with respect to said root surface.

According to an embodiment of the invention said scoop is connected to an internal diffusion channel, which extends through the root to transport said captured cooling air into the interior of the blade for cooling purposes.

According to another embodiment of the invention each scoop is provided with an external diffusion channel, which is positioned in front of said scoop and is open to said rim cavity to guide cooling air from said rim cavity into said scoop.

Specifically, said external diffusion channel is designed as a recess in the root surface.

More specifically, said external diffusion channel increases in depth and width when approaching the respective scoop.

Even more specifically, the scoop has a first cross section at its entrance, and that the external diffusion channel has a second cross section at its exit, which is adapted to that first cross section.

According to another embodiment of the invention the root of each of said blades has a leading side and a trailing side with respect to the rotation of said blades, whereby the scoop of each blade is arranged at the leading side of said root and is open to said leading side, and whereby the external diffusion channel corresponding to said scoop is arranged on the root of the neighbouring blade in rotation direction and is open to the trailing side of said blade, so that the cooling air guided by the external diffusion channel of a first blade is guided into the scoop of a second blade positioned with respect to the rotation direction directly behind said first blade.

According to a further embodiment of the invention said root surface is tilted with respect to the axis of rotation of the machine.

Specifically, the tilt angle is approximately 45°.

The turbine blade for a gas turbine according to the invention comprises a radially extending airfoil and a root with an axially oriented root surface for adjoining to an annular rim cavity of said gas turbine, whereby cooling means are provided at the root of said blade to receive cooling air being injected into said rim cavity, whereby said root surface is an essentially plane surface and said cooling means comprises a scoop for capturing and redirecting at least part of said injected cooling air, which scoop is designed as a recess with respect to said root surface.

According to an embodiment of the turbine blade invention said scoop is connected to an internal diffusion channel, which extends through the root to transport said captured cooling air into the interior of the blade for cooling purposes.

According to a further embodiment of the invention an external diffusion channel is provided at said root, which is positioned behind said scoop, is separated from said scoop and is open to said rim cavity.

Specifically, said external diffusion channel is designed as a recess in the root surface.

More specifically, said external diffusion channel increases in depth and width with increasing distance from the scoop.

Even more specifically, the scoop has a first cross section at its entrance, and that the external diffusion channel has a second cross section at its exit, which is adapted to that first cross section.

According to another embodiment of the invention the root of said blade has a leading side and a trailing side with respect to the rotation of said blade, whereby the scoop of said blade is arranged at the leading side of said root and is open to said leading side, and whereby the external diffusion channel is open to the trailing side of said blade, so that the cooling air guided by the external diffusion channel of a first blade is guided into the scoop of a second blade positioned directly behind said first blade with respect to the rotation direction.

According to another embodiment of the invention said root surface is tilted with respect to the radial direction of the airfoil.

Specifically, the tilt angle is approximately 45°.

BRIEF DESCRIPTION OF THE DRAWINGS

The present invention is now to be explained more closely by means of different embodiments and with reference to the attached drawings.

DETAILED DESCRIPTION

The invention is used for providing cooling air for an internal cooled rotating turbine blade. The internal cooling system of the blade requires cooling air at a preferably low temperature and a static pressure higher than the total relative pressure of the hot gas at the blade leading edge. To achieve the cooling requirements the blade root is equipped with a cooling air intake so called scoop. The cooling air for the scoop is provided via a cavity. The cavity is fed via stationary nozzles, delivering a total relative pressure above the total relative pressure at the blade leading edge hot gas.

Figure 1:
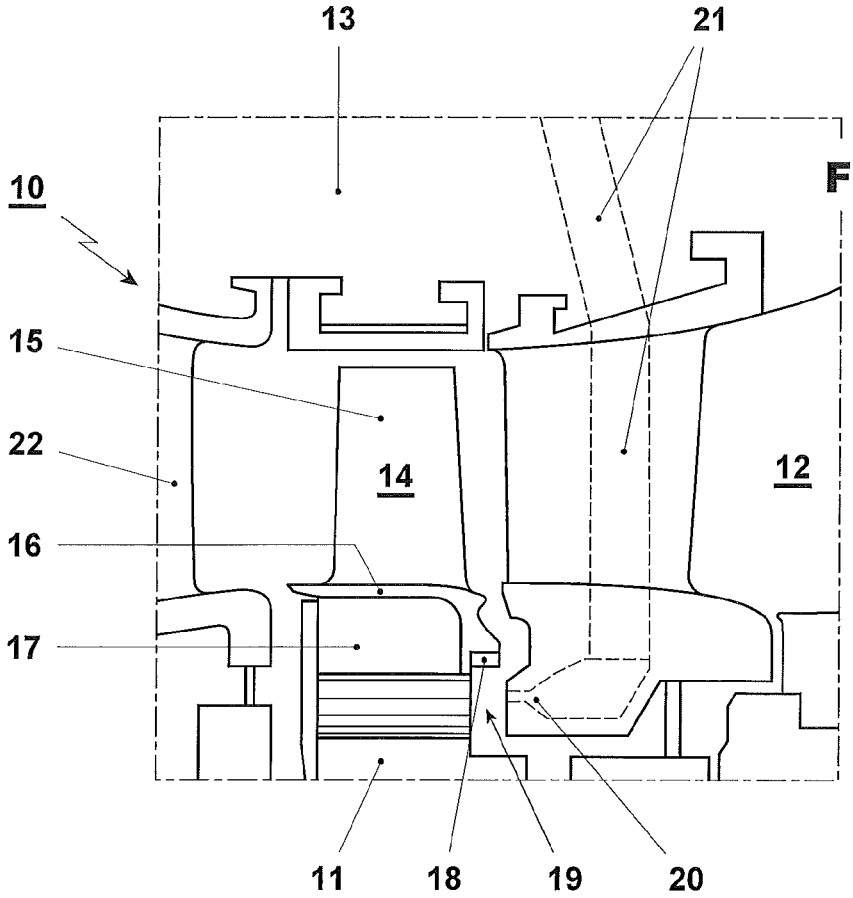
FIG. 1 shows the general flow situation for blade cooling feeds with scoops.

FIG. 1 shows in a cut-out the general flow situation for blade cooling feeds with scoops. The gas turbine 10 comprises a rotor 11, which rotates about a machine axis (not shown) and is concentrically surrounded by a casing 13. An annular hot gas channel 12 axially extends between said rotor 11 and said casing 13. The rotor 11 is equipped with a plurality of blades 14, which are arranged on said rotor 11 in an annular fashion. Each blade 14 is mounted with a root 17 in a respective axial slot on a rim of said rotor 11 and radially extends with an airfoil 15 into said hot gas channel 12. Furthermore, stationary vanes 22 are provided in said hot gas channel 12. The blades 14 adjoin with an axially oriented root surface 23 to an annular rim cavity 19, which separates the rotating blade 14 from a stationary part with cooling air nozzles 20, which are supplied with cooling air by means of a cooling air supply 21. As can be seen in FIG. 1, a scoop 18 formed at the blade root 17 extends into the rim cavity 19.

The purpose of the scoop 18 is to recover static pressure from the relative total pressure provided in the cavity 19. The needed static pressure for the blade cooling can be adjusted with an axial nozzle angle. As changing the axial nozzle angle change the relative velocities in the cavity 19 and therefore the total relative pressure in the cavity 19. The normal of the scoop throat area is approximately perpendicular to the gas turbine axis.

The cavity 19 is disturbed by purge flow/cross flow from underneath and may be/may not be sealed to the hot gas path 12. It is further disturbed by the scoop extending into the rim cavity 19.

The air intake is in general submerged in the blade root and not extending into the cavity. Computational Fluid Dynamics (CFD) calculations have shown that the flow conditions in the cavity have a main influence on the scoop recovery.

According to the invention, a submerged or integrated scoop design allows for the least disturbance of the flow in the cavity 19 and therefore for the highest recoveries. The scoop is integrated into the blade, no parts are protruding into the rim cavity (no disturbance of the flow). The air intake of the scoop has for all variants described an outside part, which diffuses the flow already before entering the scoop. This outside part increases the pressure recovery, as the diffusion inside the scoop is limited.

Figure 3:
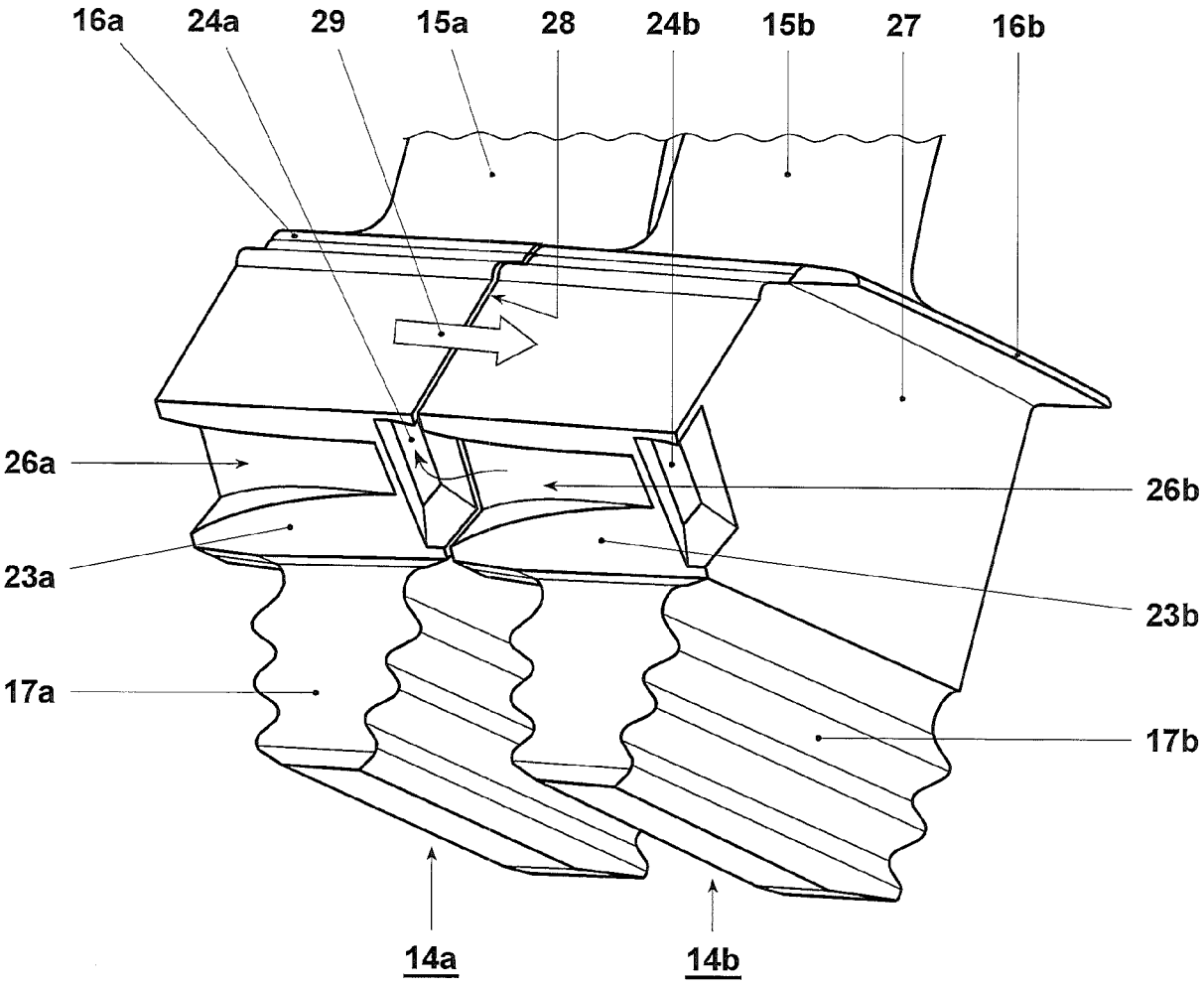
FIG. 3 shows a first embodiment of turbine blades according to the invention, with first external diffusion channels.
Figure 4:
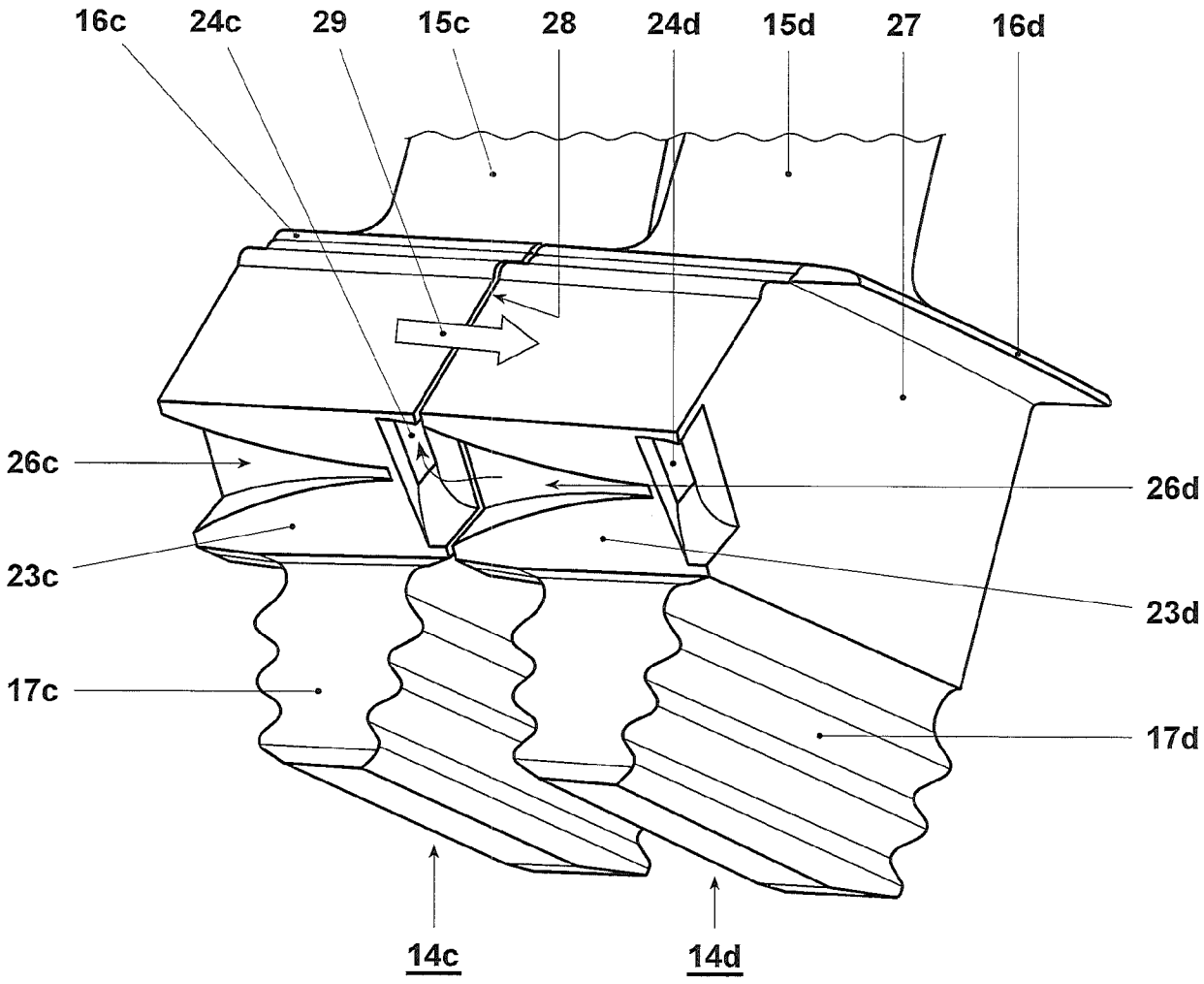
FIG. 4 shows a second embodiment of turbine blades according to the invention with second external diffusion channels.

The diffusion is divided in internal and external diffusion and takes place in two neighbouring blades (FIGS. 3 and 4). The diffusion starts in the first blade in a channel that is open to the rim cavity. The channel is shaped to allow for optimum diffusion. In the $2^{nd}$ blade the flow is guided inside to the blade cooling scheme. The internal channel is further diffusing the flow.

FIG. 3 shows a first embodiment of turbine blades according to the invention, with first external diffusion channels. A pair of neighbouring blades 14*a* and 14*b* comprises airfoils 15*a* and 15*b*, lower platforms (only platform 16*b* of blade 14*b* is shown), and roots 17*a* and 17*b*. The roots 17*a* and 17*b* have fir-tree profiles to be received by respective slots in the rim of the rotor disk. Above the fir-tree profiles plane root surfaces 23*a* and 23*b* are provided, which border the roots 17*a*, 17*b* against the adjoining rim cavity.

Integrated into each root 17*a* and 17*b* is a scoop 24*a* and 24*b*, respectively, and an external diffusion channel 26*a* and 26*b*. With respect to the rotation direction 29 (see arrow in FIG. 3) each root has a leading side 27 and a trailing side 28. The scoop 24*a*, 24*b* of each blade 14*a*, 14*b* is arranged at the leading side 27 of said root and is open to said leading side 27. An external diffusion channel 26*a*, 26*b* is arranged behind said scoop 24*a*, 24*b* and is open to said rim cavity 19 to guide cooling air from said rim cavity 19 into an associated scoop. The external diffusion channel 26*a*, 26*b* is open to the trailing side 28 of the root.

However, the scoop and external diffusion channel of one blade (e.g. scoop 24*a* and external diffusion channel 26*a* of blade 14*a*) do not co-operate with each other but are separated from each other. Instead, each scoop receives cooling air from the external diffusion channel of the next blade in rotation direction, so that (in the example of FIG. 3) the cooling air guided by the external diffusion channel 26*b* of blade 14*b* is guided into the scoop 24*a* of blade 14*a* positioned with respect to the rotation direction 29 directly behind said first blade. This pair wise co-operation of blades is true for all blades mounted on the same rotor disk.

The external diffusion channel 26*a*, 26*b* is designed as a recess in the respective root surface 23*a*, 23*b*. It increases in depth and width in a direction opposite to the rotation direction 29. It has at its exit a cross section which is adapted to the cross section at the entrance of the corresponding scoop. When the cooling air, which is guided by the external diffusion channel, enters the corresponding scoop, it is deflected into a radial direction leading to the interior of the blade airfoil through an internal diffusion channel (see 25 in FIG. 2).

FIG. 4 shows, in a drawing similar to FIG. 3, another embodiment of the invention with blade 14*c* and 14*d* comprising airfoils 15*c* and 15*d* as well as platforms 16*c* and 16*d*, and roots 17*c* and 17*d* with scoops 24*c* and 24*d* and external diffusion channels 26*c* and 26*d*. The embodiment of FIG. 4 differs from the embodiment of FIG. 3 in that the external diffusion channels 26*c*, 26*d* have a steeper tapering, and the cross section at the entrance of the scoop is increased (maximized). The scoop 24*c*, 24*d* in this case is a so-called NACA Scoop shaped according to the design rules published in the NACA release form #645 of Jul. 3, 1951.

Figure 2:
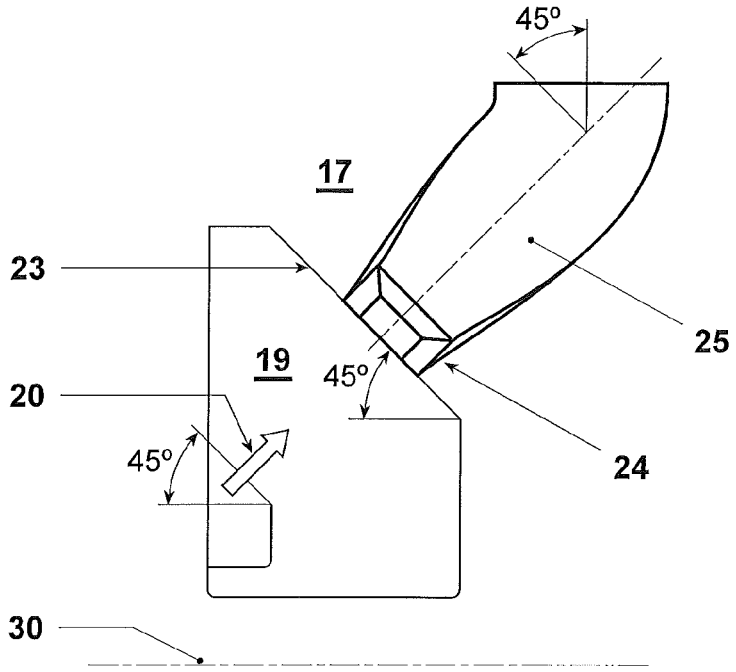
FIG. 2 shows a possible alignment of the feeding nozzles the scoop inlet.

As shown in FIG. 2, the root surface 23 is tilted with respect to the axis of rotation 30 of the machine. Specifically, the tilt angle is approximately 45°. The feeding nozzles 20 can in this case be aligned with the scoop inlet.

The invention claimed is:

1. A gas turbine, comprising:

a rotor;

a casing concentrically surrounding the rotor;

an annular hot gas channel axially extending between the rotor and the casing;

a plurality of blades, arranged on the rotor in an annular fashion, each of the blades including a root mounted in a respective axial slot on a rim of the rotor, and an airfoil extending radially into the hot gas channel, and adjoining with an axially oriented root surface to an annular rim cavity; and a scoop provided in the root of each of the blades to receive cooling air being injected into the rim cavity through stationary injectors, wherein the root surface is an essentially planar surface and the scoop is configured for capturing and redirecting at least part of the injected cooling air, the scoop being recessed from the root surface.

2. The gas turbine according to claim 1, comprising:

an internal diffusion channel, which extends through the root to transport the captured cooling air into the interior of the blade for cooling purposes.

3. The gas turbine according to claim 1, comprising:

an external diffusion channel positioned in front of the scoop and open to the rim cavity to guide cooling air from the rim cavity into the scoop.

4. The gas turbine according to claim 3, wherein the external diffusion channel is a recess in the root surface.

5. The gas turbine according to claim 4, wherein the external diffusion channel increases in depth and width when approaching the respective scoop.

6. The gas turbine according to claim 5, wherein the scoop has a first cross section at its entrance, and that the external diffusion channel has a second cross section at its exit, which is adapted to that first cross section.

7. The gas turbine according to claim 3, wherein the root of each of the blades has a leading side and a trailing side with respect to the rotation direction of the blades, that the scoop of each blade is arranged at the leading side of the root and is open to the leading side, and that the external diffusion channel corresponding to the scoop is arranged on the root of the neighbouring blade in rotation direction and is open to the trailing side of the blade, so that the cooling air guided by the external diffusion channel of a first blade is guided into the scoop of a second blade positioned with respect to the rotation direction directly behind the first blade.

8. The gas turbine according to claim 1, wherein the root surface is tilted with respect to the axis of rotation of the machine.

9. The gas turbine according to claim 8, wherein the tilt angle is approximately 45°.

10. A turbine blade for a gas turbine comprising:

a radially extending airfoil;

a root with an axially oriented root surface for adjoining to an annular rim cavity of a gas turbine; and a scoop provided in the root of the blade to receive cooling air being injected into the rim cavity, wherein the root surface is an essentially planar surface and the scoop is configured for capturing and redirecting at least part of the injected cooling air, the scoop being recessed from the root surface.

11. The turbine blade according to claim 10, comprising:

an internal diffusion channel, which extends through the root to transport the captured cooling air into the interior of the blade for cooling purposes.

12. The turbine blade according to claim 10, comprising:

an external diffusion channel provided at the root, which is positioned behind the scoop, is separated from the scoop and is open to the rim cavity.

13. The turbine blade according to claim 12, wherein the external diffusion channel is designed as a recess in the root surface.

14. The turbine blade according to claim 13, wherein the external diffusion channel increases in depth and width with increasing distance from the scoop.

15. The turbine blade according to claim 14, wherein the scoop has a first cross section at its entrance, and that the external diffusion channel has a second cross section at its exit, which is adapted to that first cross section.

16. The turbine blade according to claim 12, wherein the root of the blade has a leading side and a trailing side with respect to the rotation of the blade, that the scoop of the blade is arranged at the leading side of the root and is open to the leading side, and that the external diffusion channel is open to the trailing side of the blade, so that the cooling air guided by the external diffusion channel of a first blade is guided into the scoop of a second blade positioned directly behind the first blade with respect to the rotation direction.

17. The turbine blade according to claim 10, wherein the root surface is tilted with respect to the radial direction of the airfoil.

18. The turbine blade according to claim 17, wherein the tilt angle is approximately 45°.

* * * * *